US008267477B1

(12) United States Patent
Appiah Finn

(10) Patent No.: US 8,267,477 B1
(45) Date of Patent: Sep. 18, 2012

(54) FOLDING PORTABLE FOOTSTOOL WITH PLATFORM ADJUSTABLE TO MULTIPLE HEIGHTS AND MULTIPLE ANGLES

(75) Inventor: Julie Portia Appiah Finn, Dunwoody, GA (US)

(73) Assignee: Julie Appiah Finn, Atlanta, GA (US)

( * ) Notice: Subject to any disclaimer, the term of this patent is extended or adjusted under 35 U.S.C. 154(b) by 67 days.

(21) Appl. No.: 12/804,214

(22) Filed: Jul. 16, 2010

Related U.S. Application Data

(60) Provisional application No. 61/271,069, filed on Jul. 16, 2009.

(51) Int. Cl.
*A47C 16/00* (2006.01)

(52) U.S. Cl. ..... 297/423.41; 297/423.46; 248/456; 108/115

(58) Field of Classification Search ..... 297/423.46, 297/423.39, 423.41; 248/441.1, 454, 455, 248/456, 457
See application file for complete search history.

(56) References Cited

U.S. PATENT DOCUMENTS

| | | | | | |
|---|---|---|---|---|---|
| 70,339 | A * | 10/1867 | Kreitz | 108/9 |
| 789,813 | A * | 5/1905 | Longley | 297/423.46 |
| 3,577,936 | A * | 5/1971 | Emery | 297/423.46 |
| 5,078,056 | A * | 1/1992 | McCauley | 108/115 |
| 5,622,403 | A * | 4/1997 | Gonda | 297/423.46 |
| 7,364,129 | B1 * | 4/2008 | Levari, Jr. | 248/460 |

* cited by examiner

*Primary Examiner* — Anthony D Barfield

(57) ABSTRACT

Disclosed herein is a folding portable footstool with a support surface that is adjustable to multiple angles and multiple heights. The footstool includes a base, a first leg member, a second leg member, and a platform which when engaged by one or both of the leg members is adjustable to one of a plurality of possible angles and one of a plurality of possible heights. When neither leg member is engaged, the footstool can be folded to facilitate portability and ease of storage.

1 Claim, 27 Drawing Sheets

FOLDING PORTABLE FOOTSTOOL WITH PLATFORM ADJUSTABLE TO MULTIPLE HEIGHTS AND MULTIPLE ANGLES

CROSS-REFERENCE TO RELATED APPLICATION

This application claims the benefit of the Provisional Patent Application Ser. No. 61/271,069, filed Jul. 16, 2009, which disclosure is incorporated herein in its entirety by this reference.

TECHNICAL FIELD OF THE INVENTION

The present invention relates to a portable footstool with a footrest to make it easier for mothers to nurse and bottle feed infants.

BACKGROUND

Breastfeeding (i.e. nursing) is an important contributor to the health of both mother and child. These findings have been confirmed by countless studies over the past five decades. In addition, nursing deepens the bonds between the infant and the mother. There are many factors which contribute to successful nursing. Foremost among these is the ability of the mother to find a comfortable, relaxing position in which to nurse. Stress and discomfort can make it difficult for milk to flow, painful for mothers and ultimately discourage moms from nursing.

In order to nurse comfortably when seated without neck, arm, leg, back and shoulder strain, mothers need to elevate their feet. Without a footrest for nursing, many strain, hunch over and lift their heels putting their weight upon the balls of their feet in an effort to elevate their laps to a suitable height. Many mothers give up nursing away from home or altogether because they cannot easily achieve a comfortable position. A similar predicament often arises for parents during bottle feeding. When bottle feeding, the child must be cradled with the child's head raised at an angle often causing similar discomfort to those outlined above.

Heretofore nursing foot supports of the prior art are ottomans or nursing stools which do not fold making them difficult to store and transport. Folding footstools of the prior art which are not intended specifically for caring for a baby do not provide an angled surface to absorb the downward pressure from the user's legs while being adjustable to multiple positions to best accommodate the user's needs. Many other disadvantages of the prior art will become apparent to one skilled in the art after comparing such prior art with the present invention described herein. None of the prior art, taken either singly or in combination, is seen to describe the instant invention as claimed. Thus a folding footstool adjustable to multiple heights and multiple angles is desired.

In view of the foregoing disadvantages and problems inherent in existing footstools and ottomans known in the prior art, the present invention provides a lightweight, strong, portable footstool which is suitable to create an incline surface upon which mothers rest their feet when nursing. A folding, portable nursing footstool would enable mothers to nurse or bottle feed comfortably anywhere in their home as well as to nurse or bottle feed when away from home. The present invention provides these needed benefits.

SUMMARY OF THE INVENTION

The present invention comprises a footstool that is lightweight, portable and easy to use. The footstool of the present invention is suitably used by nursing mothers to facilitate breastfeeding or bottle feeding while on the go. The footstool is constructed from a lightweight material such as bamboo, wood, plastic or a combination thereof. The footstool is suitably foldable or collapsible to facilitate portability and storage.

In broad aspects, the portable nursing footstool of the present invention comprises a compact platform suitable for elevating feet in a manner that provides comfort during a nursing operation or bottle feeding. The portable nursing footstool of the present invention can be easily foldable (or collapsible) to provide portability and to facilitate storage. The portable nursing footstool is suitably configured to provide structure wherein a nursing mother (or anyone seeking to rest her feet) can place her feet on the device and the device provide such support without resting the device against another object.

The portable footstool can be configured in a number of ways including but not limited to providing a single or multiple support surfaces which are rigid or substantially taut.

DETAILED DESCRIPTION

Figure 1:
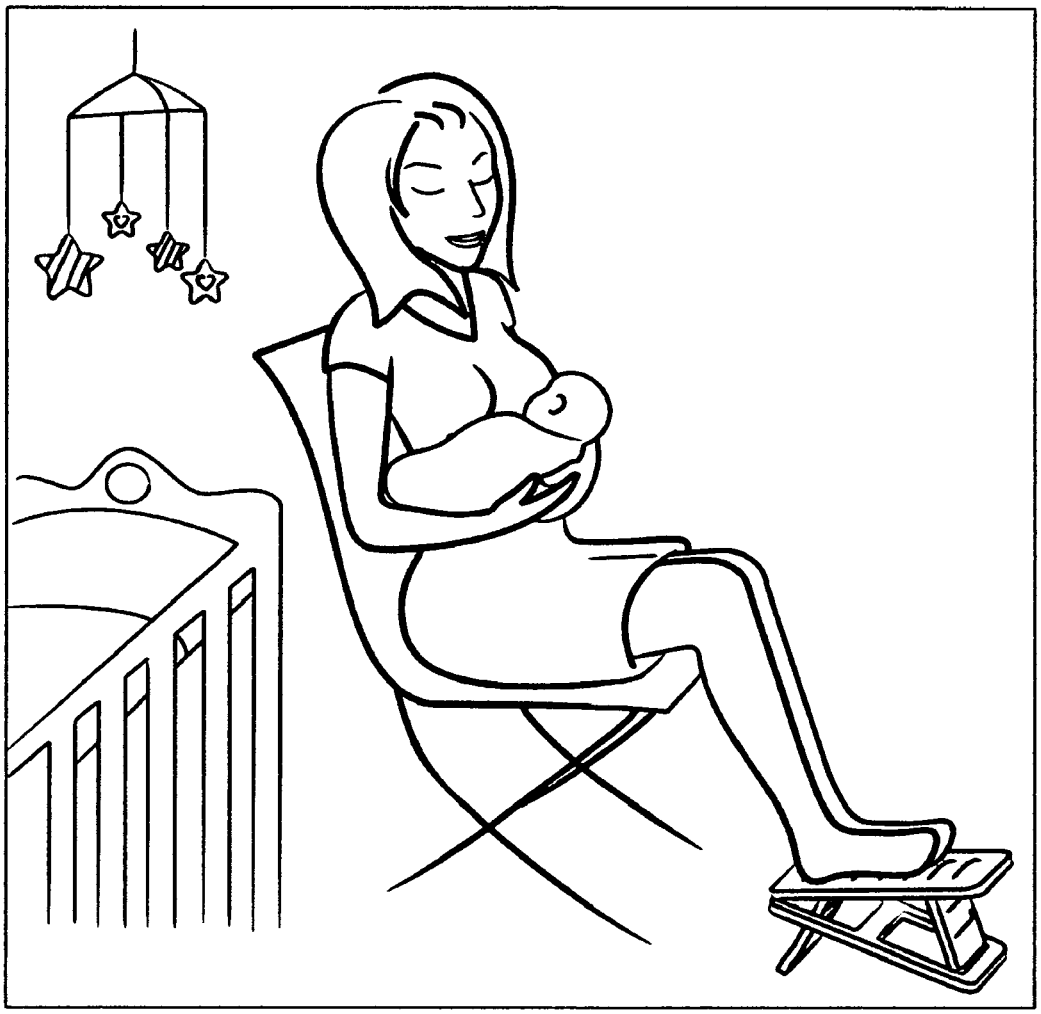
FIG. 1 illustrates how a mother may utilize the footstool of the present invention while nursing a baby.

In one aspect of the present invention, the portable nursing footstool of the present invention comprises at least three surfaces when configured together create a planar (or substantially planar) support surface capable of elevating and supporting one's feet without needing any additional or external means of structural support. The nursing footstool of the present invention comprises a base, a first leg member nested within the base, and a platform for resting one's feet at an incline to a floor or other surface. This platform is attached to the base with a hinging mechanism and provides the primary support surface where the nursing mother will place her feet during the nursing or bottle feeding operation. The first leg member is attached to the base via a hinging mechanism and when this leg member is rotated the top of the leg member engages an indentation on the bottom of the platform thereby elevating the platform at a first angle defining a first position.

The portable nursing footstool of the present invention can also comprise a second leg member nested within the base via a pivot mechanism, which when engaged along with a first leg member, enables the device to create an elevated support surface at a second angle which is parallel (or nearly parallel) defining a second position. Such ergonomic features are believed to improve the overall comfort during a nursing operation, which, in turn, is believed to make it more likely that nursing will occur "on the go" or throughout the home.

In another aspect of the present invention, the nursing footstool of the present invention comprises a base, a first leg member nested within the base, and a platform for resting one's feet at an incline to a floor or other surface. The first leg member is attached to the base via a hinging mechanism and has notches cut from the engaging end thereby creating an extension member. The platform is attached to the base with a hinging mechanism and can have a plurality of slits operable for receiving this extension member. When this first leg member is rotated the extension member on the end of the leg member engages a slit of the platform thereby elevating the platform. By allowing the first leg member to engage alternate slits in the platform, the platform can be set at different angles to allow the user to adjust the incline of the support surface. The portable nursing footstool of the present invention can also comprise a second leg member nested within the base via a pivot mechanism, which has notches cut from the engaging end thereby creating a second extension member. When the second leg member is engaged, this second extension member is received by one of the slits in the platform. When engaged along with a first leg member, this second leg member enables the device to create an elevated support surface which is parallel (or nearly parallel) to the floor.

In another aspect of the present invention, the nursing footstool comprises a base, first and second leg members nested within the base, a connector connecting the leg members, and a platform for resting one's feet at an incline to a floor or other surface. The platform is attached to the base with a hinging mechanism. The first leg member is attached to the base via a hinging mechanism and the second leg member is attached to the base via a pivot mechanism. To ensure the relative stability and comfort of the user, the second leg member also has stability members extending out orthogonally from each side that engages the floor creating a wider foot thereby helping to ensure the footstool does not easily tip over. The first and second leg members are operable for supporting the platform. The connector is attached to each leg member and causes them to operate simultaneously when the first leg is engaged thereby helping the user to operate the footstool with one hand. The connector can also be a rigid structural member connecting the first and second leg members to each other thereby helping to facilitate one-handed operation of the nursing footstool of the present invention. The first and second leg members have cutouts to allow the structural member to move in a pivot motion.

In yet another aspect of the present invention, the nursing footstool of the present invention comprises a base, first and second leg members nested within the base, a structural member connecting the leg members, a lock assembly in the structural member, and a platform for resting one's feet at an incline to a floor or other surface. The platform is attached to the base with a hinging mechanism and provides the primary support surface for the user. The first leg member is attached to the base via a hinging mechanism and the second leg member is attached to the base via a pivot mechanism. The first and second leg members are operable for supporting the platform. To ensure the relative stability and comfort of the user, the second leg member also has stability members extending out orthogonally from each side that engages the floor creating a wider foot thereby helping to ensure the footstool does not easily tip over.

The first and second leg members have cutouts to allow the structural member to move in a pivot motion. The structural member further contains a lock assembly and hollow pegs or raised cylindrical protrusions to connect the structural member to the second leg. These cylindrical protrusions can create a pivot mechanism connecting the second leg member and the structural member. The second leg member further contains channels in the inside edges of the opening created by the cutouts wherein the hollow pegs or raised cylindrical protrusions can slide along the channels allowing the footstool to be operated with the first leg without the structural member engaging the second leg, in other words to be put in the first position.

The lock assembly is housed in a recess in the structural member and contains a locking mechanism including a lock pin or tubular member which when received by a lock tube or cylindrical barrel aperture in the second leg member, engages the lock. When this locking mechanism is engaged, the structural member can no longer slide in the channels of the second leg and instead rotates in a pivot motion. When the locking mechanism is engaged, operating the first leg causes the structural member to also operate the second leg i.e. both legs are operable for supporting the platform at a second angle to the horizontal achieving the second position. The structural member extends between the first and second leg members and helps to facilitate one-handed operation of the nursing footstool.

Those who have cared for infants will acknowledge that ease of use is often critical for tools for infant care or else they will not be readily used. As such, an important feature of the present invention is that it can be easily engaged by a person (e.g., nursing mother) attempting to prepare herself and her surroundings for a nursing operation. Additional features can help the user to operate the footstool with one hand. For example, a pull strap attached to the first leg which can help to operate the first leg when the locking mechanism is not engaged and can help to operate both leg members when the lock is engaged.

To provide improved comfort and security during a nursing operation, the platform support surface can be substantially non-slip. This non-slip aspect can be provided by one or more of grooves, slits, bumps, polymeric material or the like. The specific configuration of the platform is not believed to be critical to the non-slip properties of the portable nursing footstool of the present invention. The platform may also have slits or grooves to decrease the overall weight of the footstool as well as to increase traction and aeration.

Additional improvement and security during a nursing operation can be provided when one or more parts of the portable nursing footstool which are in contact with the floor comprise a non-skid property. A suitable way to provide such non-skid property is by coating or otherwise applying a polymeric material to some or all of those parts of the portable nursing footstool that are in contact with the floor. Examples can be rubber feet or appliqués or a polymeric coating. As would be recognized by one of ordinary skill in the art, such material will increase the coefficient of friction of the portable nursing footstool so as to make it less likely to slide or move across a floor when a user places pressure on it during use.

The portable nursing footstool of the present invention can be comprised in whole or in part of plywood (veneer, softwood, or hardwood), solid hardwood, solid softwood, bamboo, rubberwood, metal, or plastic. Other materials can also be suitable as long as the features of the present invention can be achieved without diminishing the ability to use the footrest comfortably or reducing the desirable portability of the invention. Specifically, the material must have a fairly low thermal conductivity, long life (i.e. be durable), and be able to be made into a smooth surface. In order to successfully achieve the balance of comfort, portability and strength for the portable nursing footrest, the various components can be mixed and matched. Additionally, the platform support surface can comprise canvas, fabric, leather, nylon, etc. combined with other materials to further improve the portability by taking weight out of the final product.

Still further, the portable nursing footstool of the present invention should be configured so as to reduce the possibility that opening or closing will result in pinching.

In contrast to currently available footstools, which may or may not be intended for nursing mothers, the portable nursing footstool of the present invention is lightweight and portable so that it can be easily moved within and outside of the home. Moreover, it is compact and can be folded for ease of storage and portability (e.g., it can suitably be carried in a diaper bag and easily stored).

In use, the present invention will allow a mother (or other person) to elevate her feet with a device that does not need external support and which can be folded for easy portability and storage. In this way, back, shoulder, neck and lower leg strain can be alleviated. While the present invention is intended for nursing and bottle feeding mothers, it should be understood that it can be useful for other situations where a portable way to provide foot support is desirable. Such situations include, but are not limited to, pregnancy, guitar playing, air travel, knitting or other hobbies, reading, watching television, to assist petite people to sit more comfortably or in numerous other situations.

One aspect of the portable footstool 100 of the present invention is shown in FIGS. 2,3,4,5,6 and 7. The footstool 100 has a platform 102, a base assembly 168, a first leg member 114 and a second leg member 124. I presently contemplate that the platform 102 is generally flat and generally rectangular in shape. However, it may have different dimensions and shapes. The platform has a first top surface 104, a first bottom surface 160, a first front edge 106, a first back edge 158, and first and second side edges 112. The platform also has planar or mostly planar support surface 108. The support surface 108 of the platform has a non-slip means 198 comprised of grooves, indentations, polymeric materials, or another suitable configuration. The first bottom surface 160 of the platform 102 has a plurality of indentations 110.

The base assembly 168 has arms 132 and back 126 constructed as a unitary member but which could also be constructed of multiple members. The base assembly 168 has a second top surface 138, a second bottom surface 150, a second front edge 127, a second back edge 157, a third and fourth side edges 116 and 170. The arms 132 further define a base opening with a first inside edge 115 and a second inside edge 118. The bottom surface 150 of base assembly 168 has a first non-skid means comprised of rubber or some polymeric materials. The base assembly 168 is attached to the platform 102 via a hinging mechanism 130. I presently contemplate that the base assembly 168 is generally flat and generally U-shaped and is generally the same width and length as the platform 102. However, it may have different sizes, dimensions, and shapes. For example, the base assembly 168 could be generally X-shaped or it could be generally H-shaped with an additional structural member between the arms 132.

The first leg member 114 can be generally flat and rectangular shaped and is generally the same depth as the base assembly 168 and is no wider than base opening. However, it may have different sizes, dimensions, and shapes. The first leg member 114 is constructed as a unitary member but could also be constructed of multiple members. The first leg member 114 has a third top surface 134, third bottom surface 142, third front edge 162, third back edge 144, fifth side edge 136 and sixth side edge 164. The first leg member 114 rests in the base assembly 168 between the first inside edge 115 and the second inside edge 118 with sufficient space to allow free movement and is connected to the base assembly 168 via a hinging mechanism 130.

The second leg member 124 is generally flat and rectangular shaped and is generally the same depth as the base assembly 168 and is no wider than the base opening. However, it can have different sizes, dimensions, and shapes. The second leg member 124 is constructed as a unitary member but could also be constructed of multiple members The second leg member 124 has a fourth top surface 140, fourth bottom surface 148, fourth front edge 152, fourth back edge 122, seventh and eighth side edges 123. The second leg member 124 rests in the base assembly 168 between the first inside edge 115 and the second inside edge 118 with sufficient space to allow free movement and is connected to the base assembly 168 via a pivot mechanism 154. The fourth back edge 122 has a second non-skid means comprised of rubber or some polymeric material.

Figure 3:
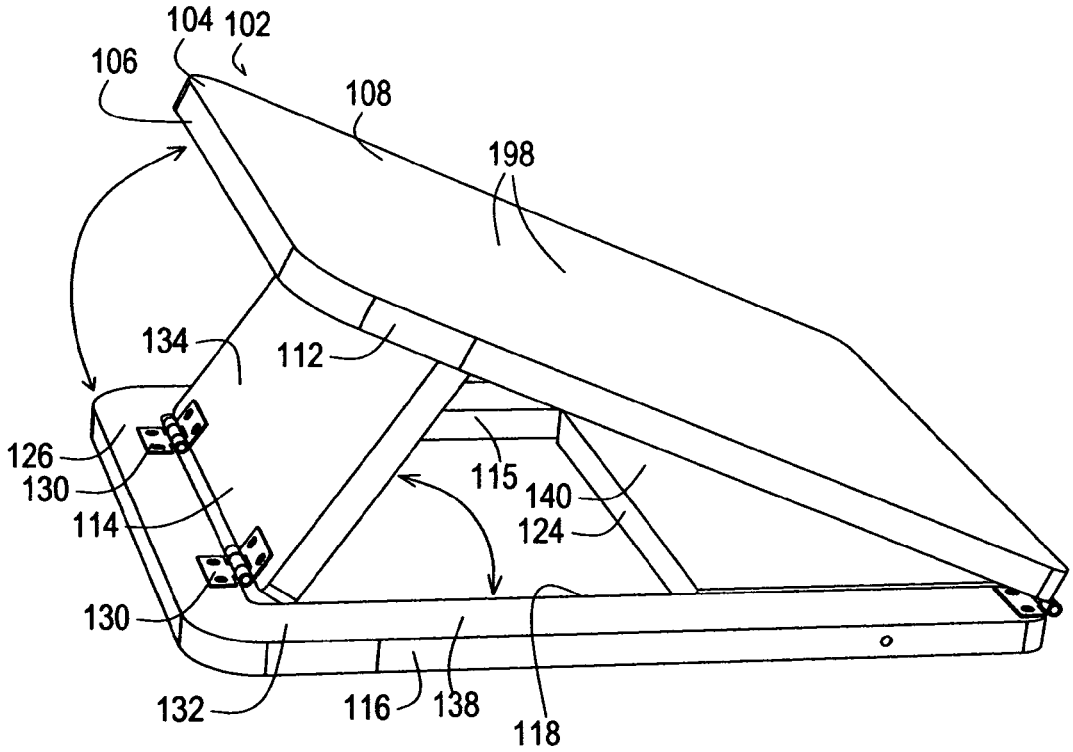
FIG. 3 is an exemplary depiction of one configuration of the footstool of the present invention in an engaged orientation suitable for use.

Now referring to FIG. 3, the first front edge 106 of the platform 102 is elevated when the first leg member 114 is rotated and the third back edge 144 of the first leg member 114 engages one or more indentations 110 on the first bottom surface 160 of the platform 102. However, different configurations are possible. For example, the first leg member 114 could also be attached to the base assembly 168 such that the first front edge 106 of the platform 102 is elevated when the third front edge 162 of the first leg member 114 engages one of the indentations 110 on the first bottom surface 160 of the platform 102. When so positioned, the platform 102 is in a first open or first position defining a first angle with the horizontal. The planar or nearly planar support surface 108 is at an incline facing the user.

Figure 2:
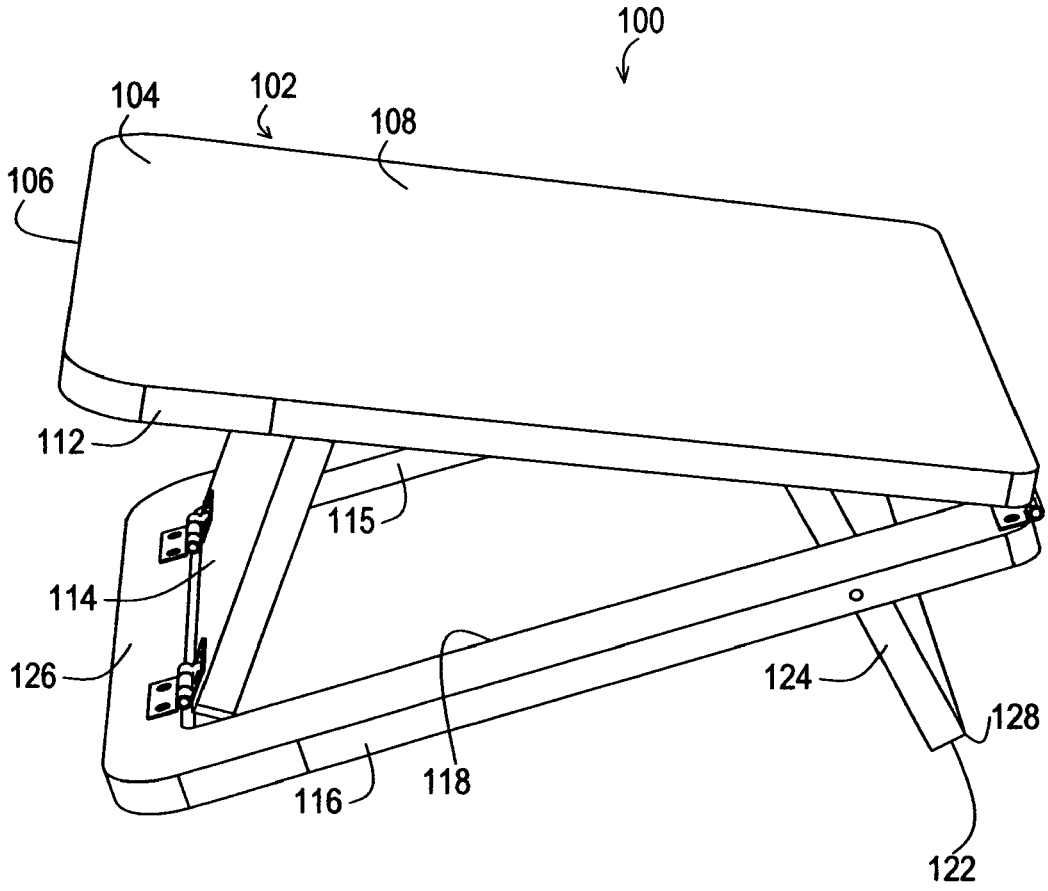
FIG. 2 is an exemplary depiction of one configuration of the footstool of the present invention in an engaged orientation suitable for use.
Figure 4:
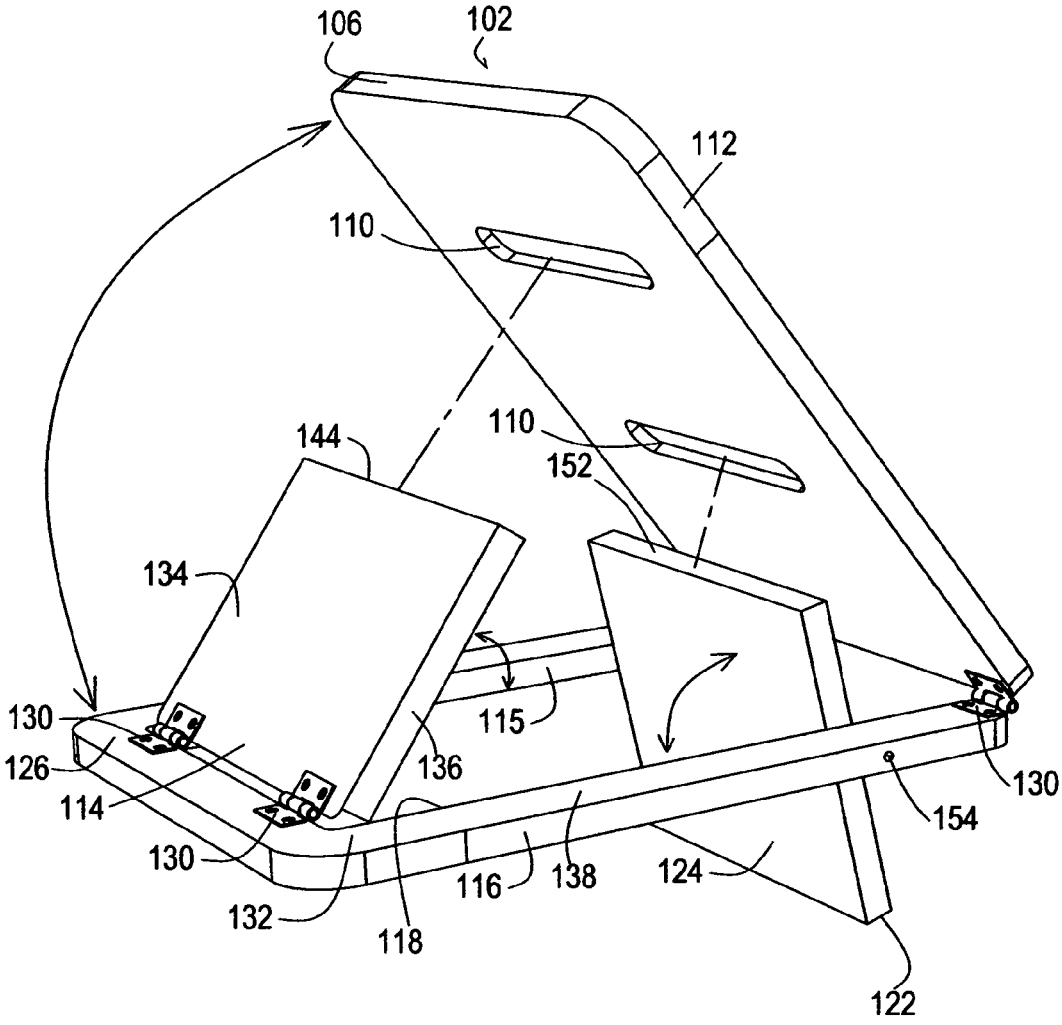
FIG. 4 is an exemplary depiction of one configuration of the footstool of the present invention in a partially engaged orientation.
Figure 5:
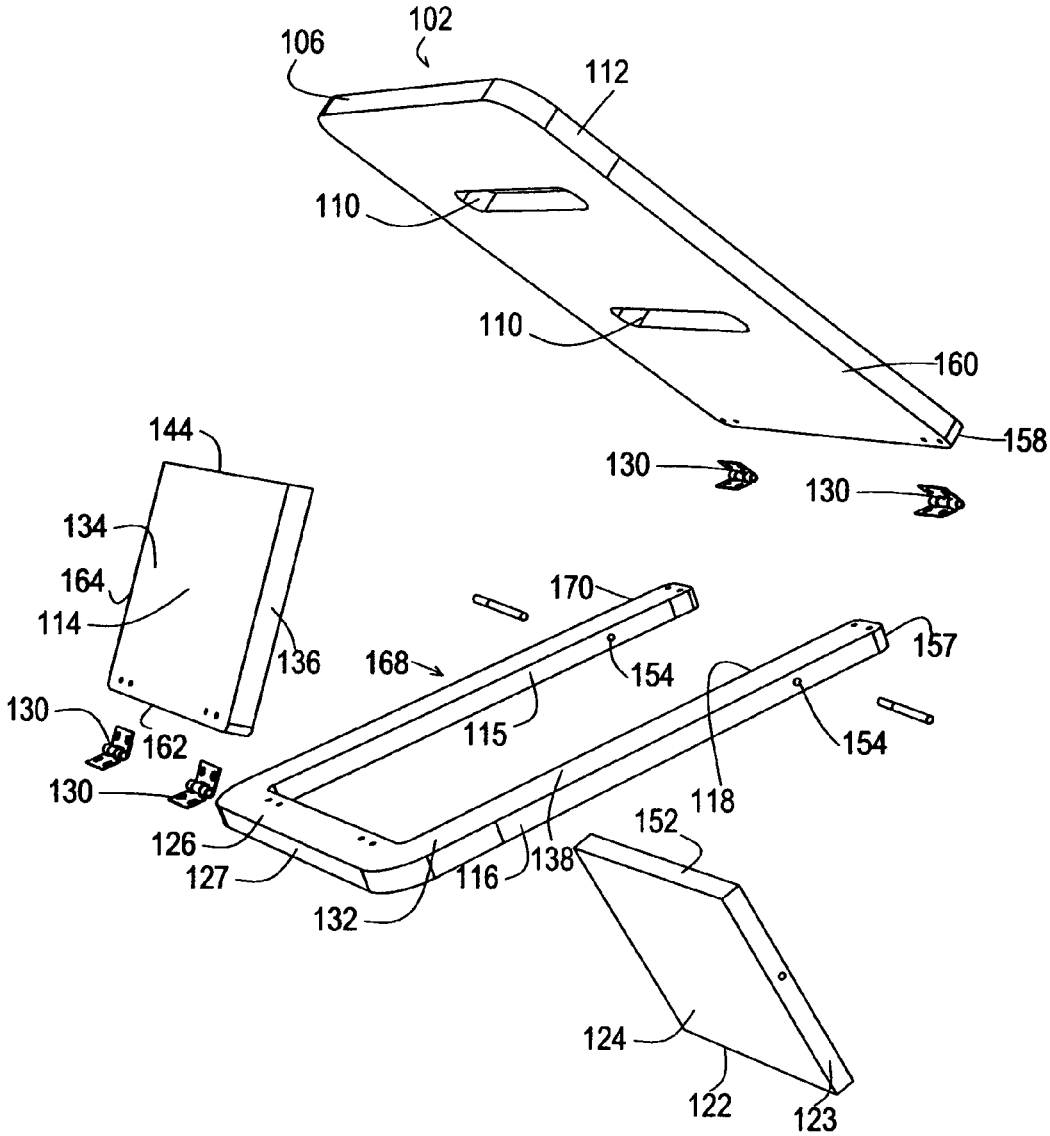
FIG. 5 is an exploded orthogonal view of one aspect the footstool
Figure 6:
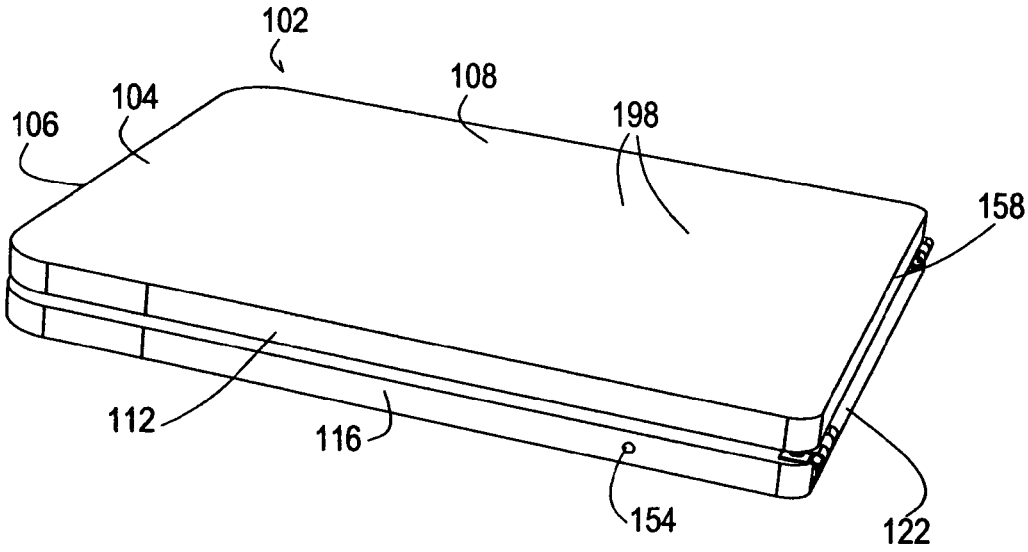
FIGS. 6 and 7 are exemplary depictions of one configuration of the footstool of the present invention in a fully collapsed orientation.
Figure 7:
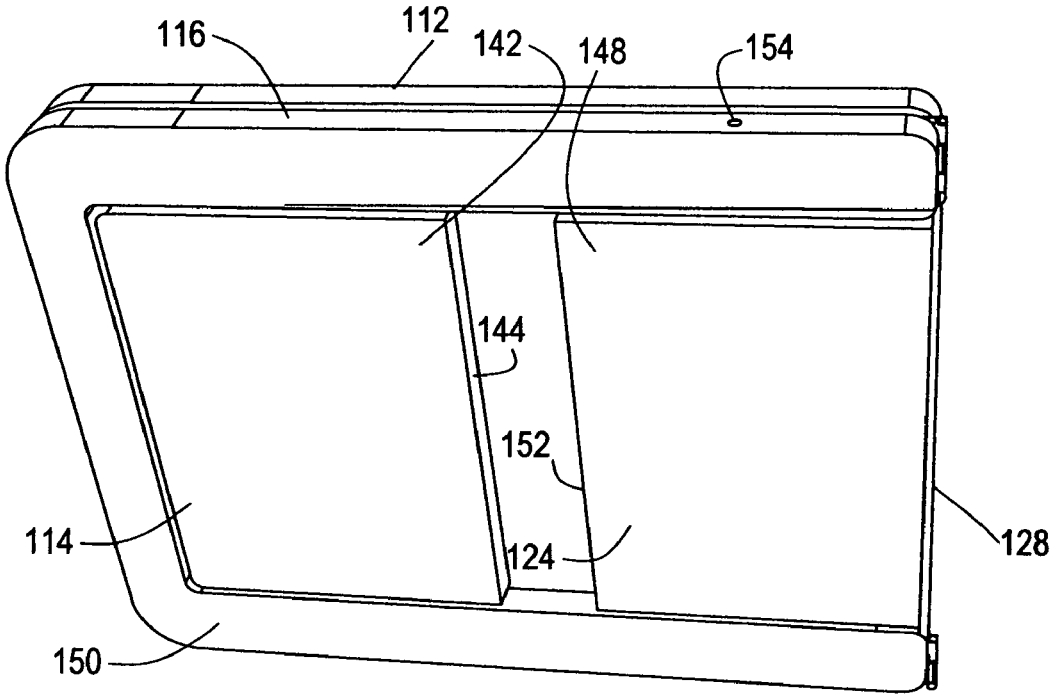

FIGS. 2 and 4 show that the second back edge 122 of the base assembly 168 and the first back edge 158 of the platform 102 are elevated when the second leg member 124 is rotated and the fourth front edge 152 of the second leg member 124 engages one or more indentations 110 on the first bottom surface 160 of the platform 102 and when the fourth back edge 122 of the second leg member 124 engages the ground or floor. When so positioned, the footstool 100 and the platform 102 are in a second open or second position defining a second angle with the horizontal. The second angle is smaller than first angle and thereby enables the planar or nearly planar support surface 108 to be at a smaller incline or parallel or nearly parallel with the horizontal.

When neither the first nor the second leg members 114 and 124 are engaged, the footstool 100 of the present invention is in a closed position in which the platform 102 lies on top of base assembly 168. When in the closed position, the first and second leg members 114 and 124 lie flat against the platform 102 and do not extend beyond the base assembly 168 i.e. are flush or nearly flush with the base assembly 168 thereby creating a generally flat configuration which is portable and easy to store.

It will be understood that different shapes and dimensions of the base assembly 168, platform 102, support surface 108, and leg members 114 and 124 can be used and different configurations and attachment mechanisms can be used without departing from the spirit and scope of the invention. For example, the platform 102 could have multiple indentations for engaging the first leg member 114 thereby enabling the user to place the platform 102 in additional positions and defining additional angles with and heights from the horizontal.

Now referring to FIGS. 8,9,10, 11, 12 and 13, in a further aspect of the invention, the platform 202 may contain slits 210. The third back edge of the first leg member 214 may contain a first and second shoulder or notches 242 and 246 thereby defining a first nub or first extension member 244 and the fourth back edge of the second leg member 224 may contain a third and fourth shoulder or notch 248 and 250 thereby defining a second nub or second extension member 252. It would be understood that different configurations are possible. For example, the first leg member 214 could also be attached along the third back edge and the first and second shoulders or notches 242 and 246 and the first extension member 244 along the third front edge of the first leg member 214. To further improve the stability of the footstool of the present invention, the second leg member 224 may have stability members 220 extending outward orthogonally from the seventh and eighth side edges creating a foot which helps to prevent the footstool from wobbling or tipping over. The second leg member 224 with stability members 220 can be constructed as a unitary member but could also be constructed of multiple members.

Figure 9:
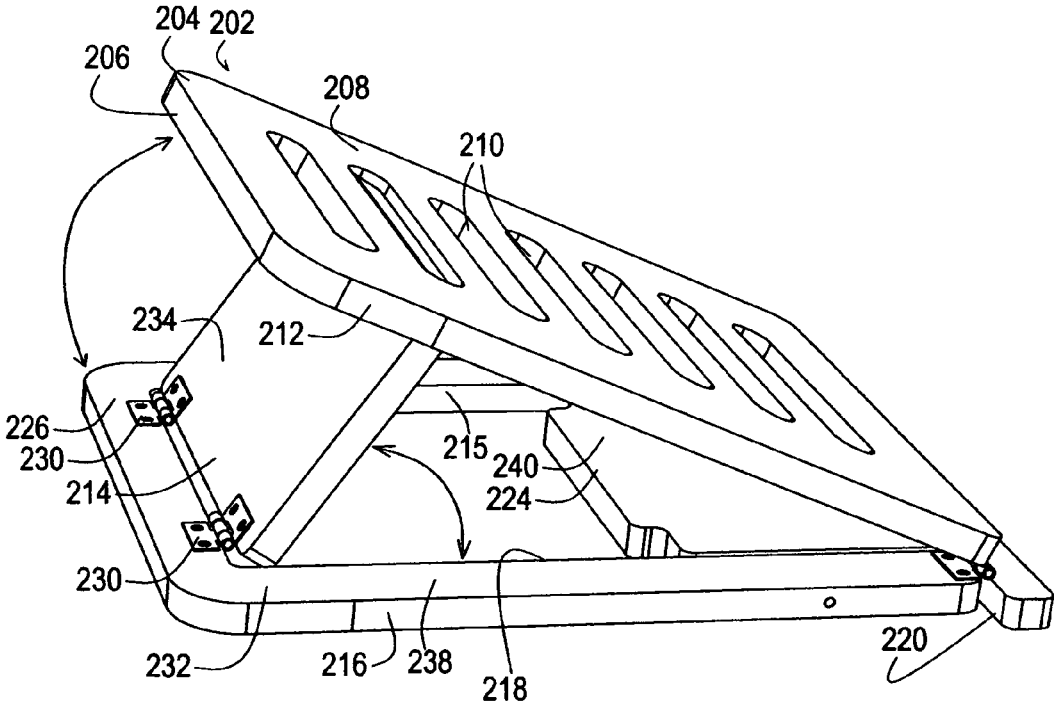
FIG. 9 is an exemplary depiction of another configuration of the footstool of the present invention in an engaged orientation suitable for use

As shown in FIG. 9, the first front edge 206 of the platform 202 is elevated when the first leg member 214 is rotated and the first extension member 244 of the first leg member 214 engages one or more slits 210 through the platform 202 allowing the platform 202 to rest on the first and second notches 242 and 246 of the first leg member 214. When so positioned, the platform 202 is in the first position and creates the first angle with the horizontal. The planar or nearly planar support surface 208 is at an incline facing the user. It will be appreciated that additional configurations are possible. For example, the platform 204 could have multiple slits for engaging the first leg member 114 thereby enabling the user to place the platform 204 in additional positions and defining additional angles with and heights from the horizontal.

Figure 8:
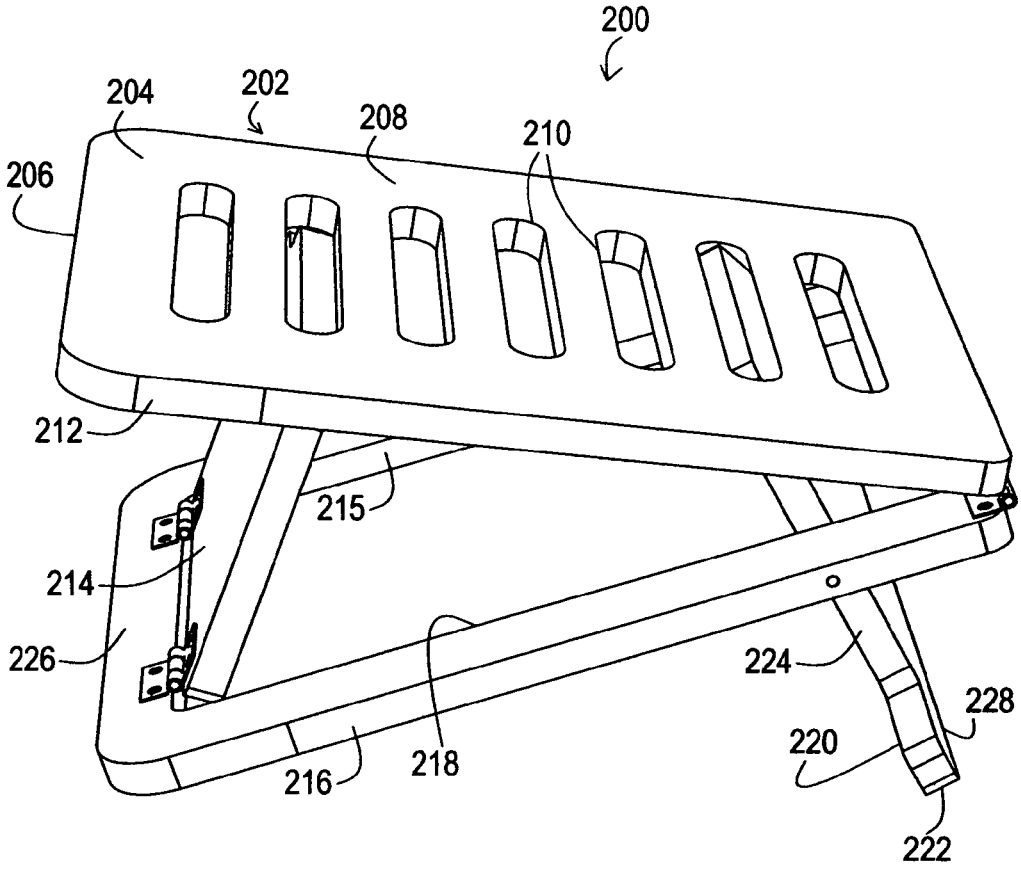
FIG. 8 is an exemplary depiction of another configuration of the footstool of the present invention in an engaged orientation suitable for use
Figure 10:
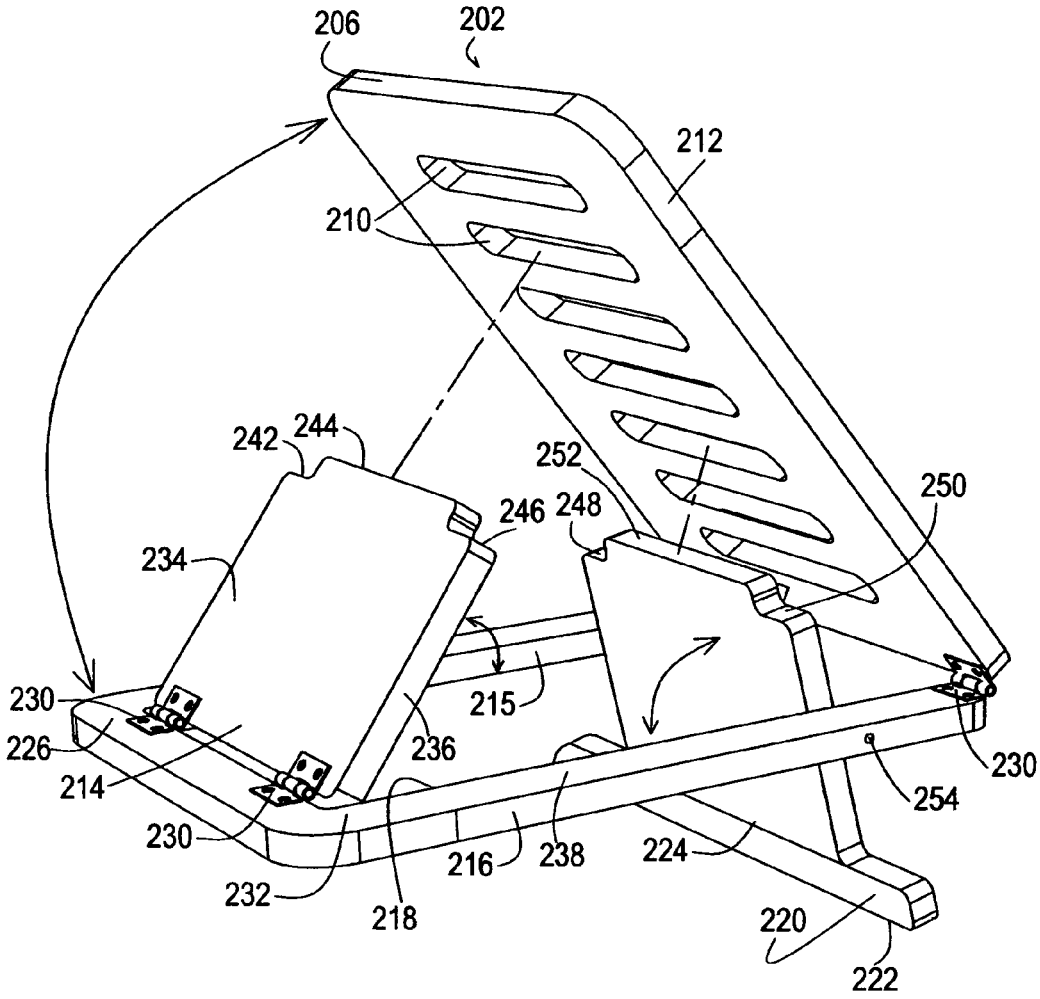
FIG. 10 is an exemplary depiction of another configuration of the footstool of the present invention in a partially engaged orientation.
Figure 11:
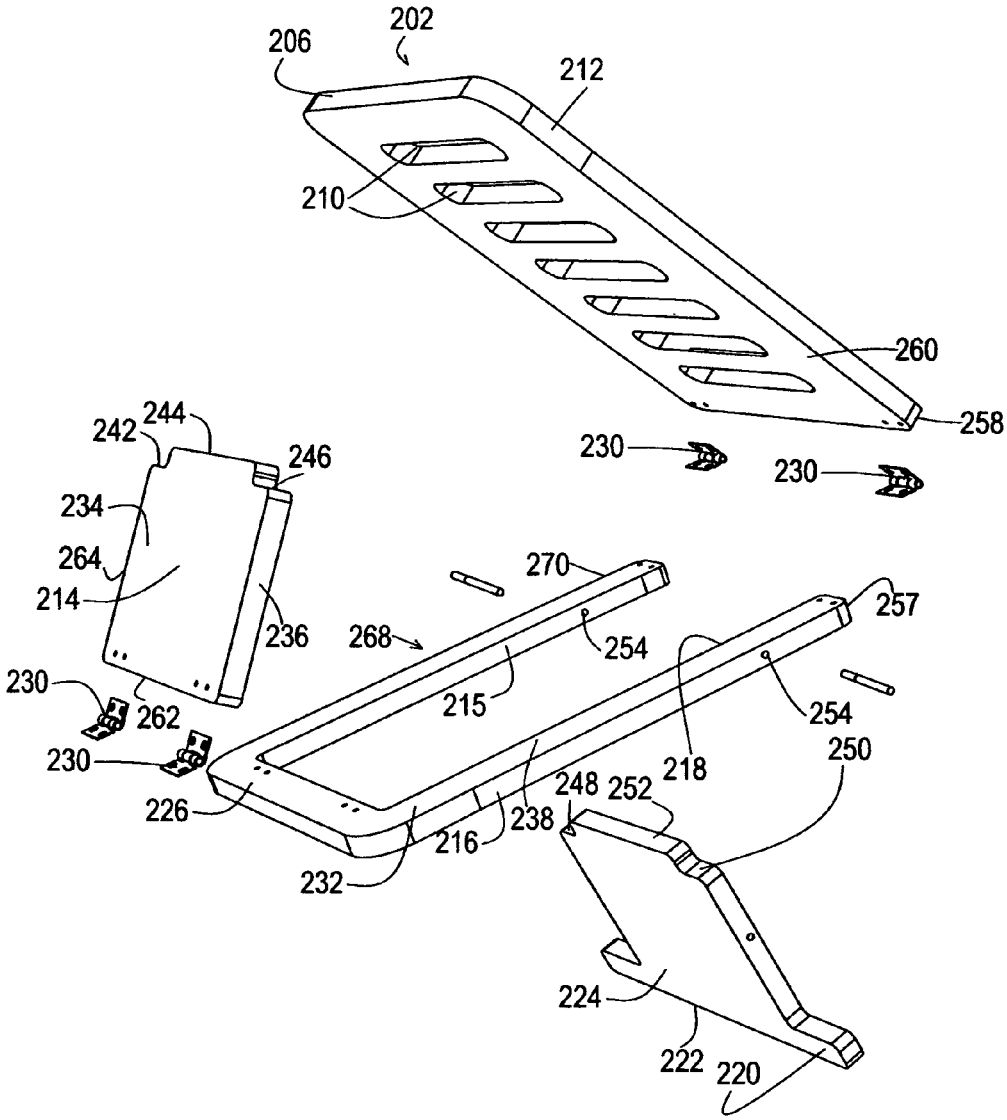
FIG. 11 is an exploded orthogonal view of another aspect the footstool

As FIGS. 8,10 and 11 depict, the second back edge 257 of the base assembly 168 and the first back edge 258 of the platform 204 are elevated when the second leg member 224 is rotated and the second extension member 244 of the second leg member 224 engages one or more slits 210 through the platform 202 allowing the platform 202 to rest on the third and fourth notches 248 and 250 of the second leg member 224 and when the fourth back edge 222 of the second leg member 224 engages the ground or floor. When so positioned, the platform 202 is in a second position defining a second angle with the horizontal. The second angle is smaller than first angle and thereby enables the planar or nearly planar support surface 208 to be parallel or nearly parallel with the horizontal.

Figure 12:
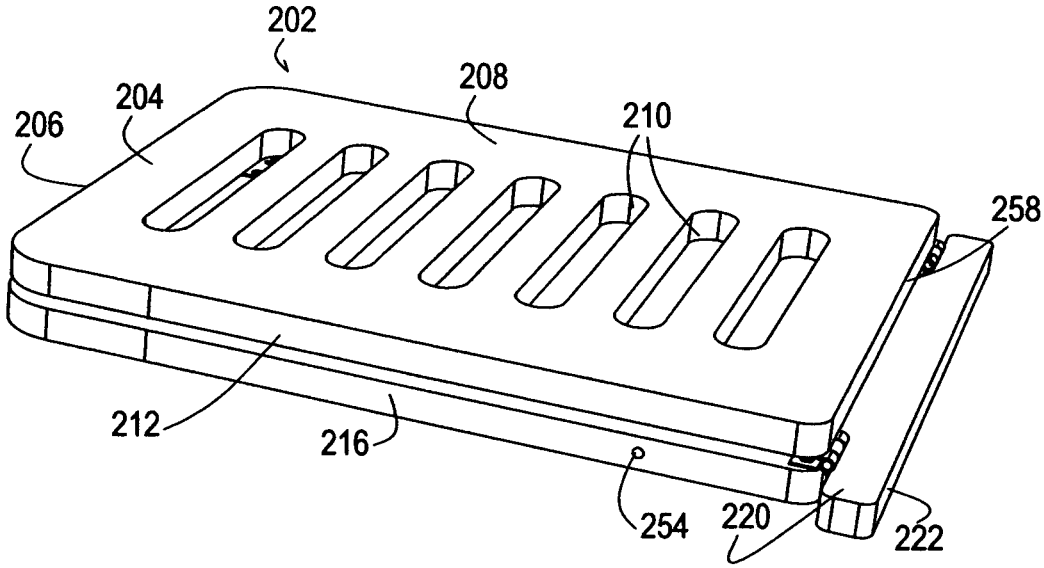
FIGS. 12 and 13 are exemplary depictions of another configuration of the footstool of the present invention in a fully collapsed orientation
Figure 13:
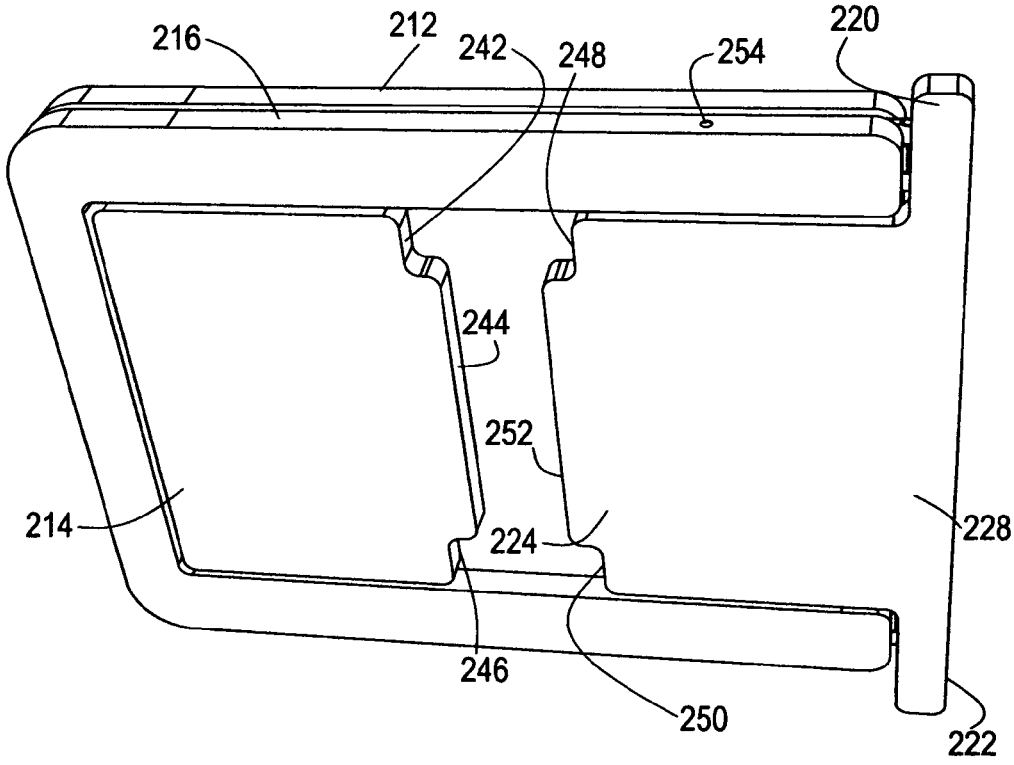

As FIGS. 12 and 13 depict, when neither the first nor the second leg members 214 and 224 are engaged, the footstool of the present invention is in a closed position in which the platform 202 lies on top of the base assembly. When in the closed position, the leg members lie flat against the platform 202 and are flush with or nearly flush with the base assembly thereby creating a support apparatus which is portable and easy to store.

Figure 14:
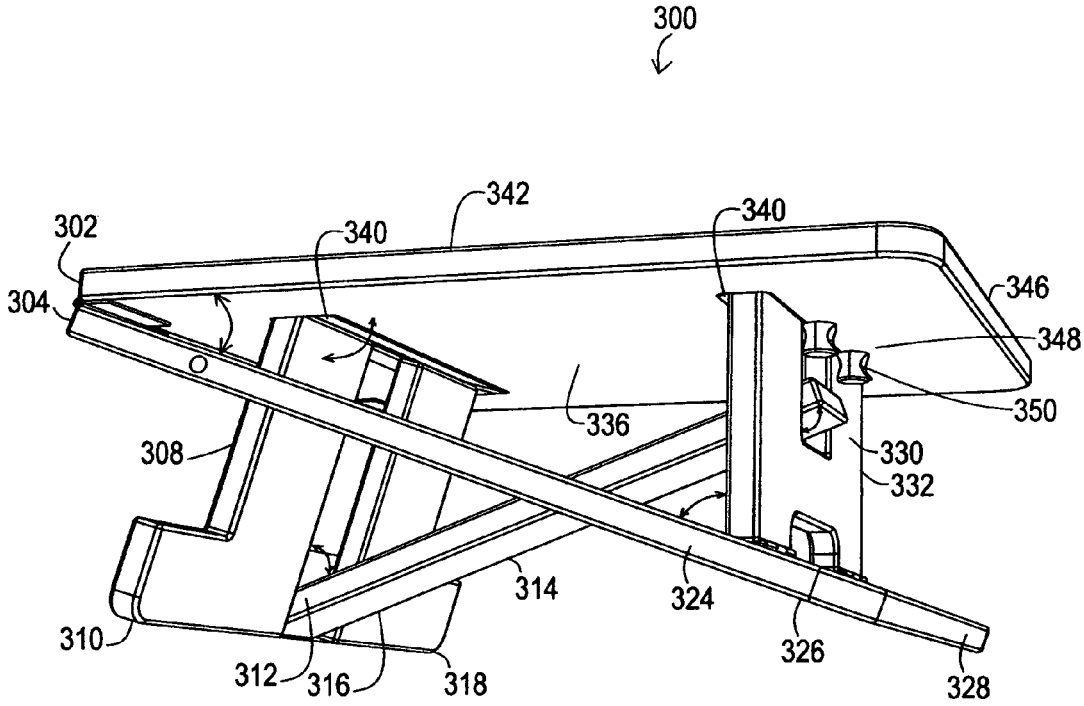
FIG. 14 is an exemplary depiction of yet another configuration of the footstool of the present invention in an engaged orientation suitable for use
Figure 15:
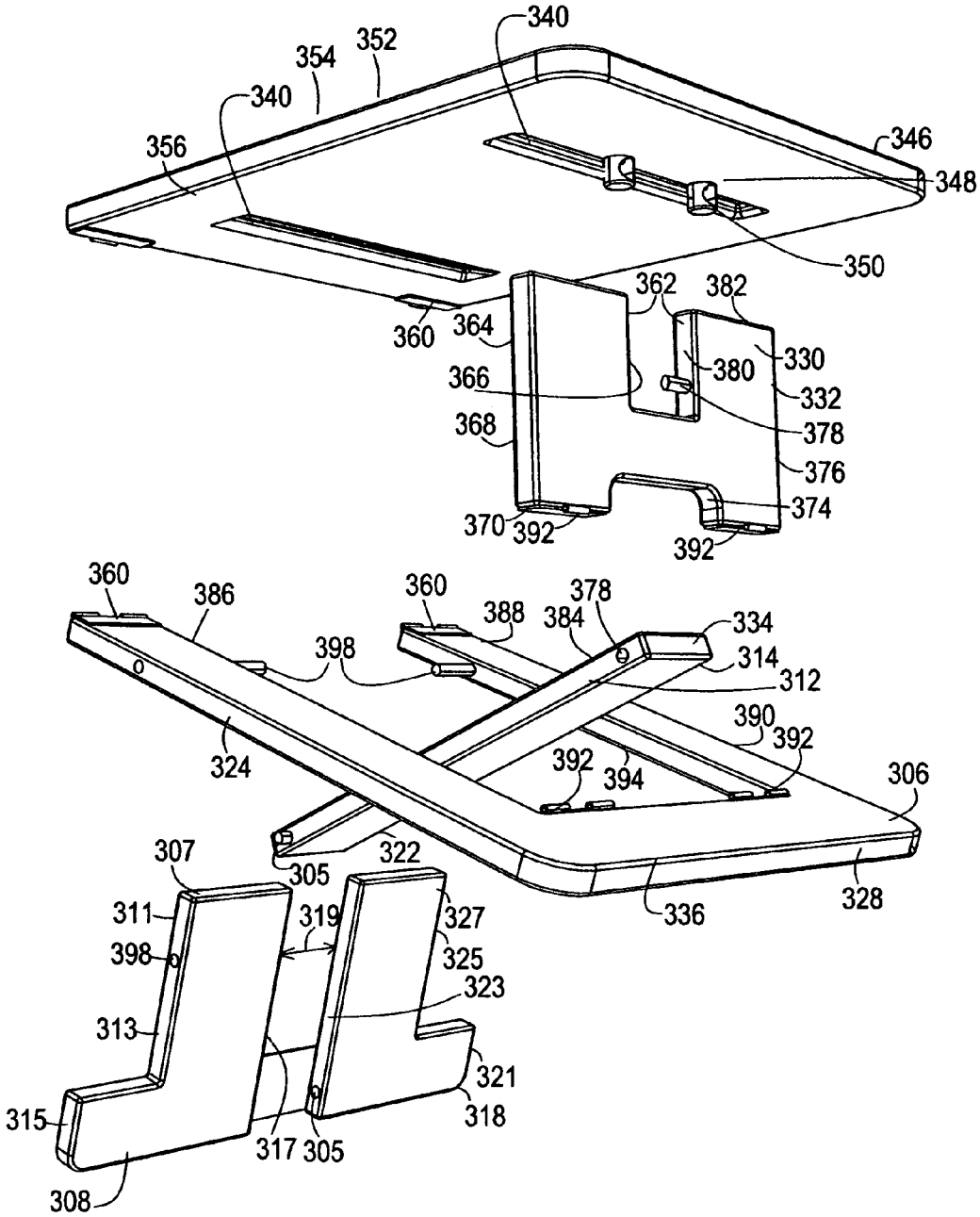
FIG. 15 is an exploded orthogonal view of yet another aspect the footstool
Figure 16:
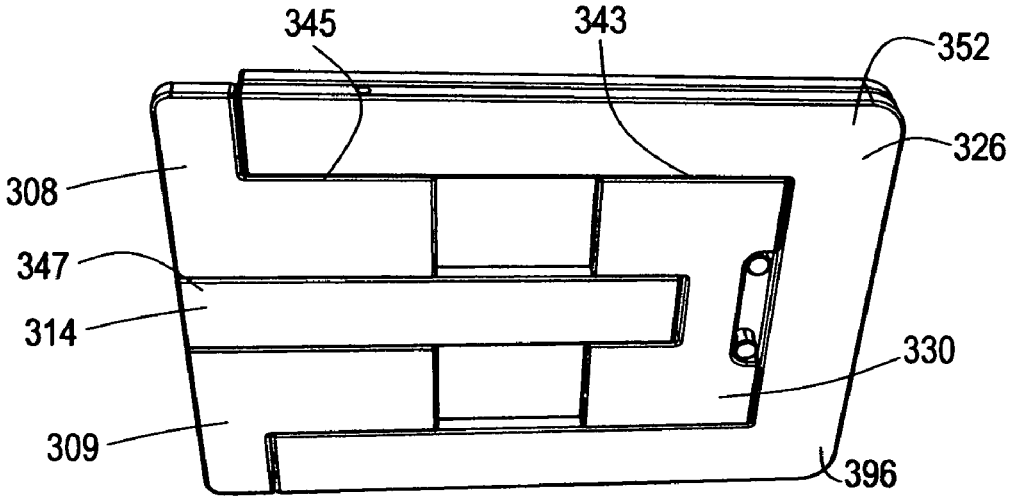
FIG. 16 is an exemplary depiction of yet another configuration of the footstool of the present invention in a fully collapsed orientation
Figure 17:
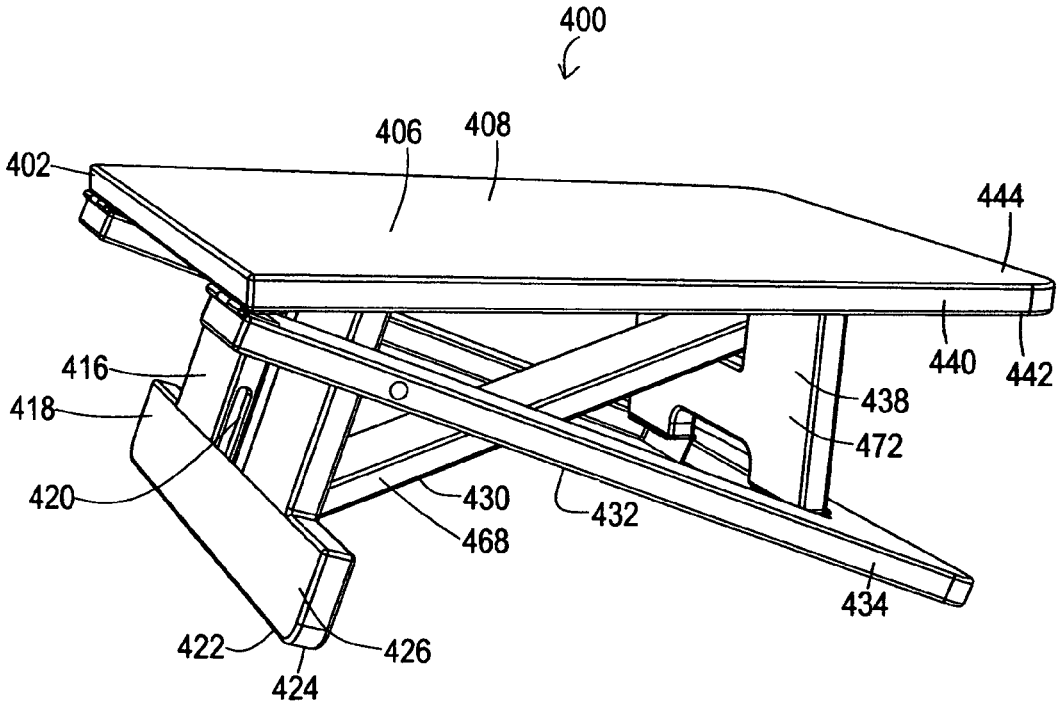
FIGS. 17 and 18 are a exemplary depictions of still yet another configuration of the footstool of the present invention in an engaged orientation suitable for use
Figure 18:
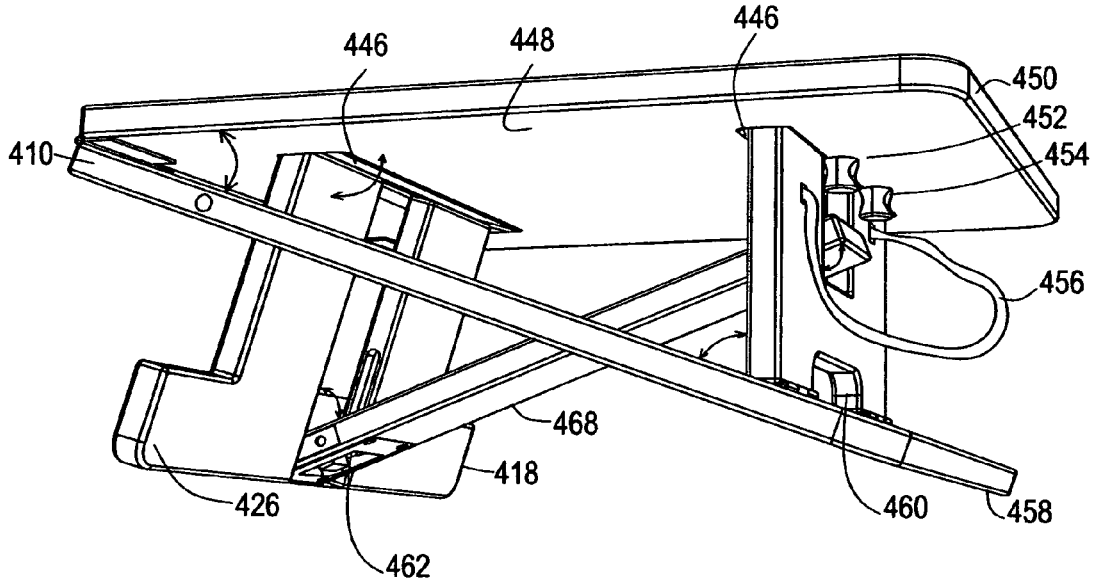
Figure 19:
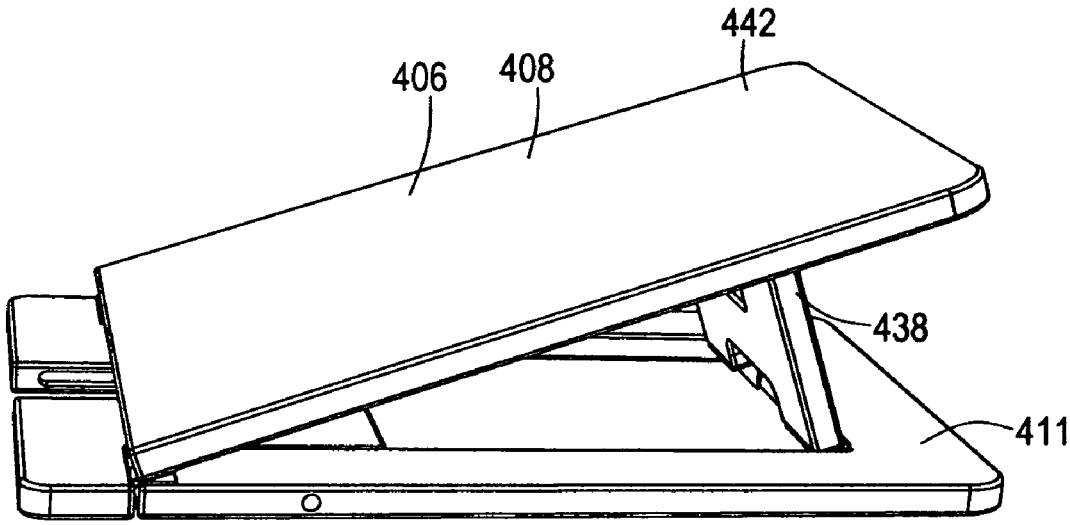
FIG. 19 is an exemplary depiction of another configuration of the footstool of the present invention in an engaged orientation suitable for use
Figure 20:
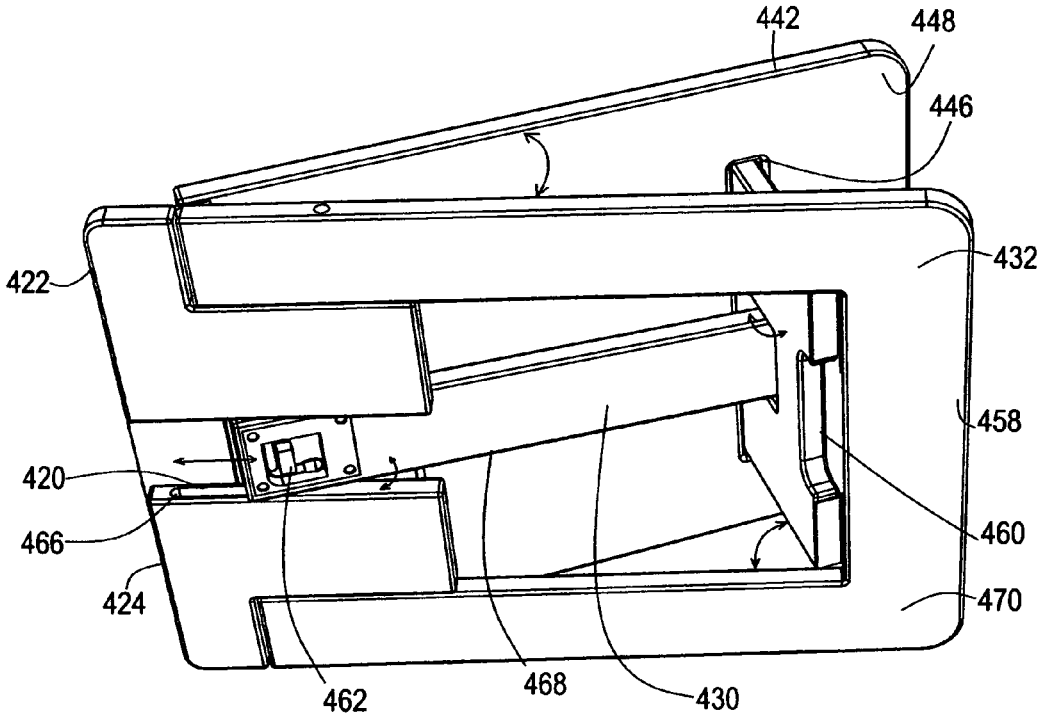
FIG. 20 is a view from the bottom of another configuration of the footstool of the present invention in an engaged orientation suitable for use
Figure 21:
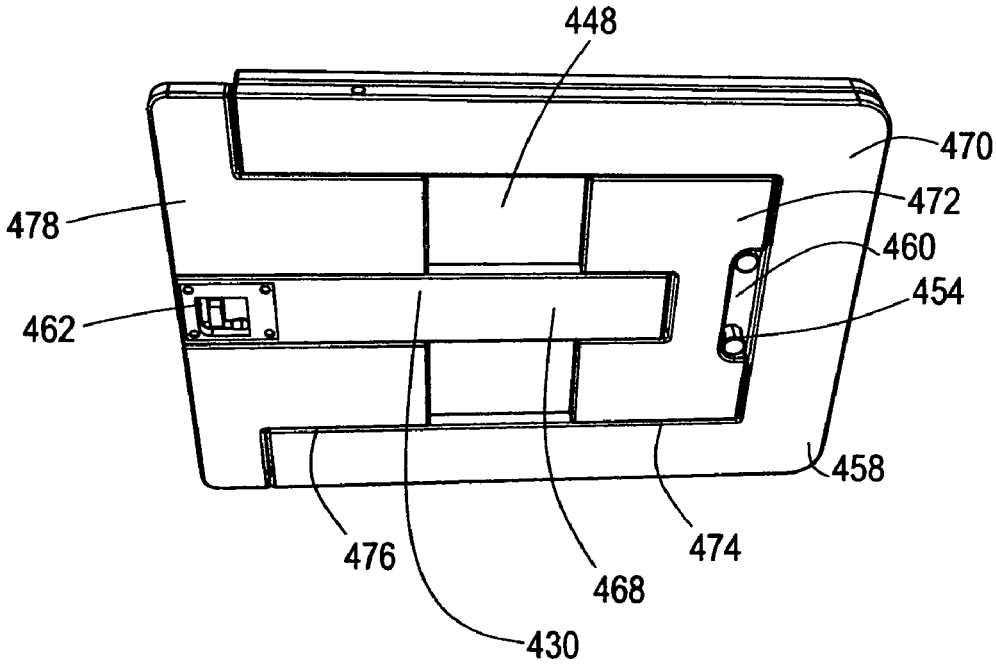
FIG. 21 is an exemplary depiction of yet another configuration of the footstool of the present invention in a fully collapsed orientation
Figure 22:
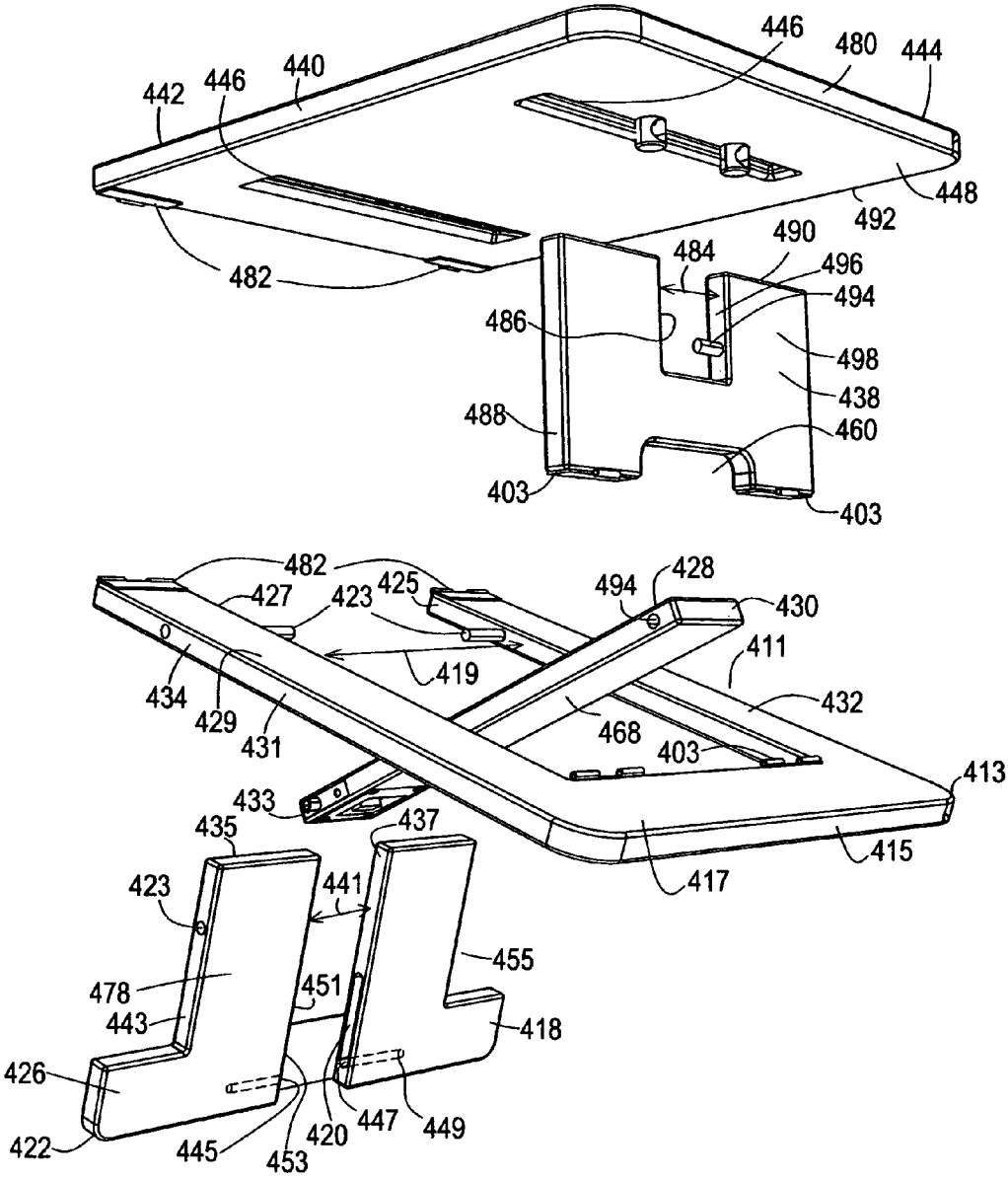
FIG. 22 is an exploded orthogonal view of yet another aspect the footstool
Figure 23:
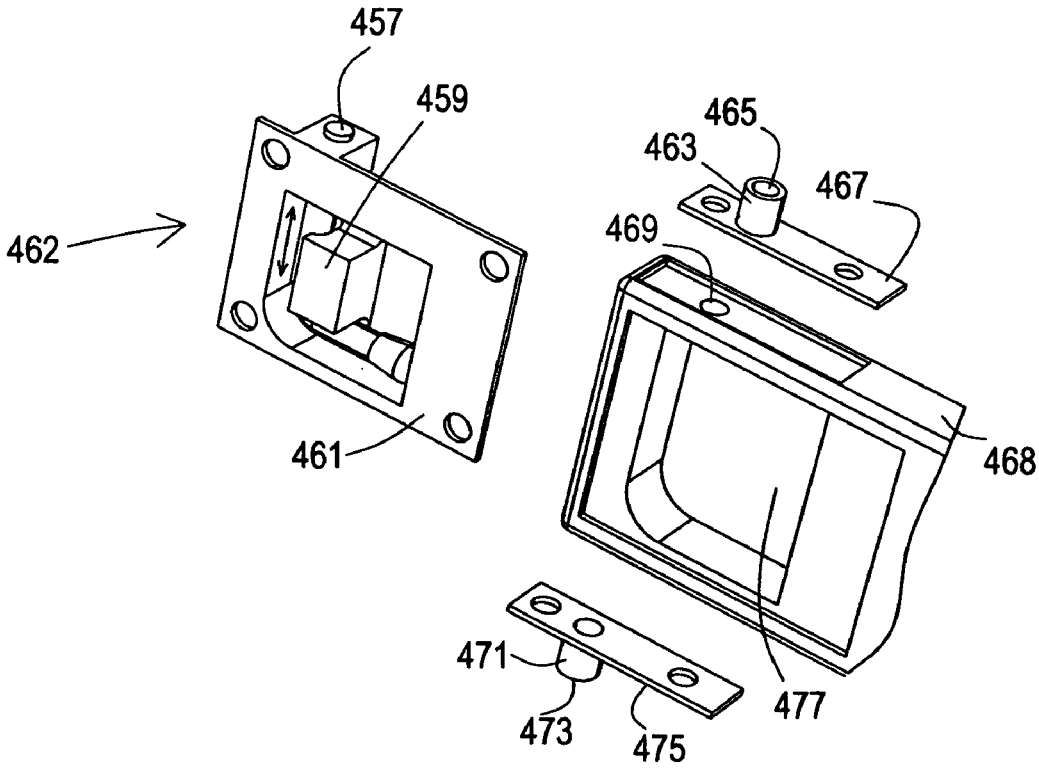
FIG. 23 is an exploded view of the locking mechanism of the present invention
Figure 24:
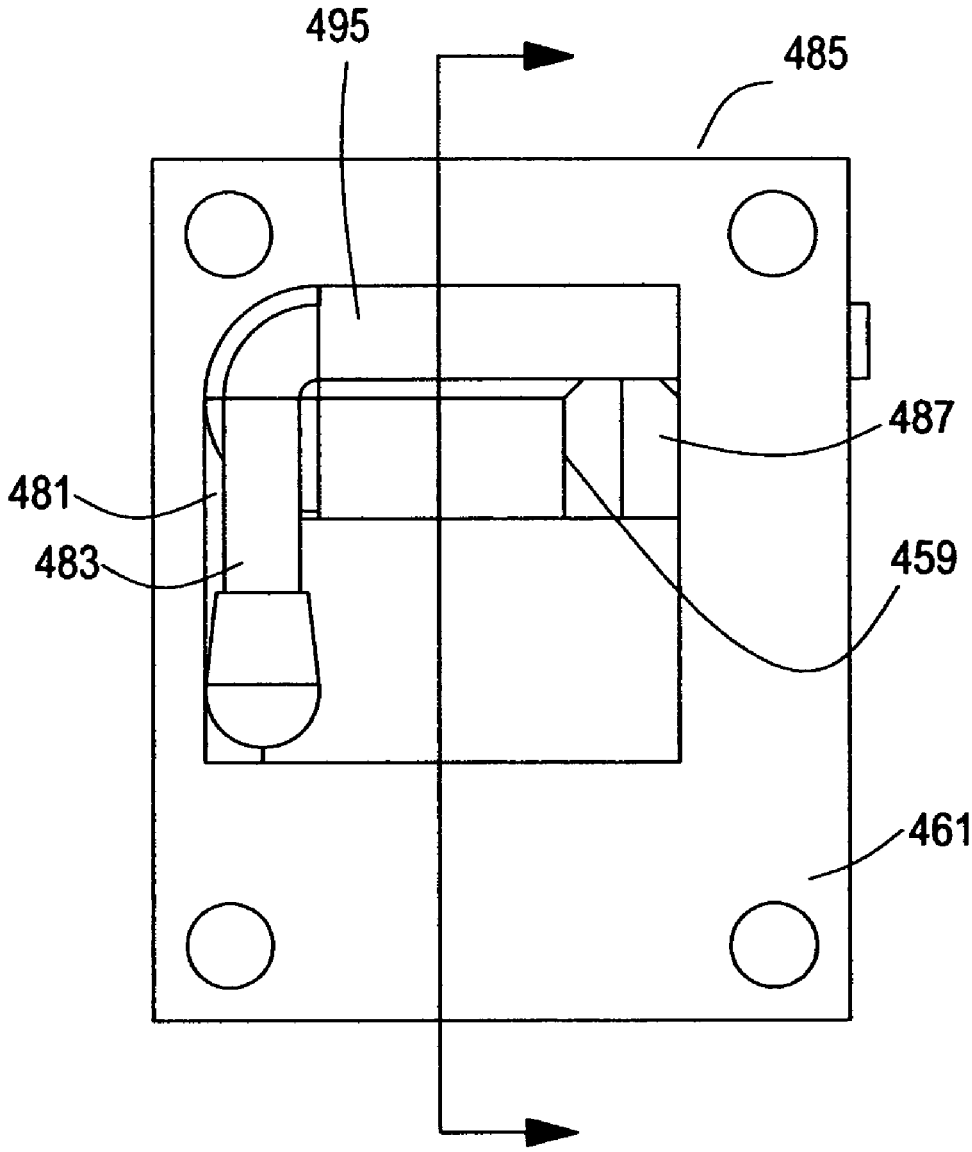
FIG. 24 is a detailed view of the lock house assembly of the present invention when the lock is not engaged
Figure 25:
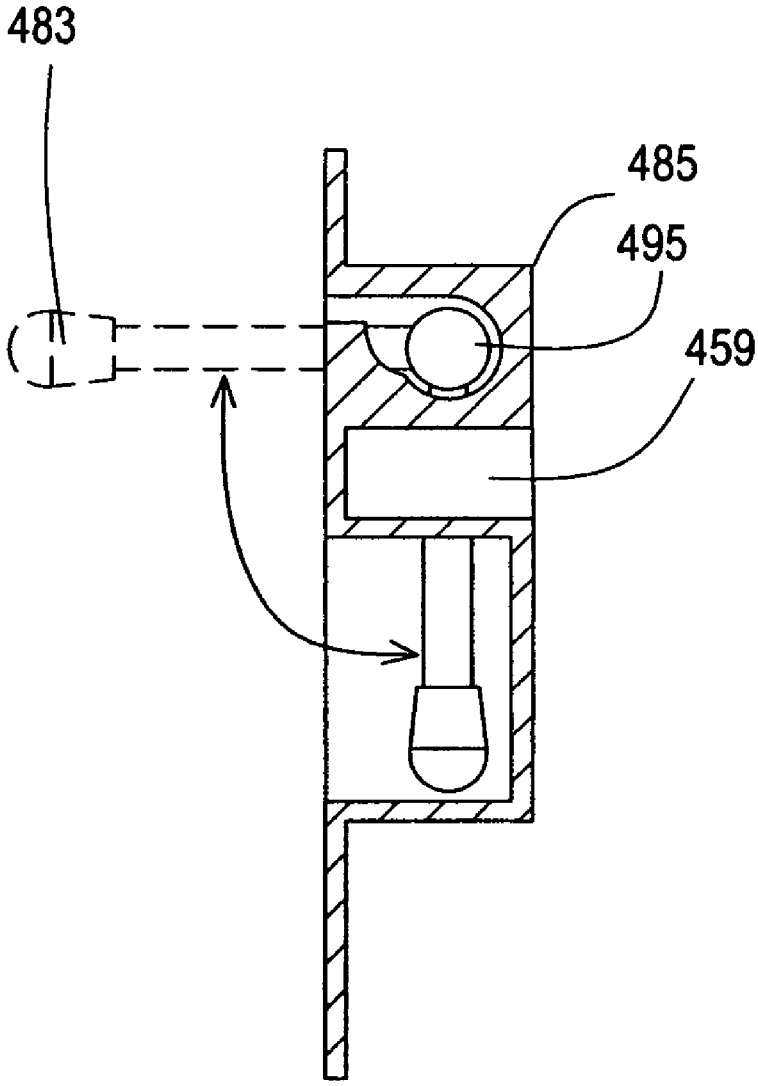
FIG. 25 is a depiction of the movement for engaging the lock
Figure 26:
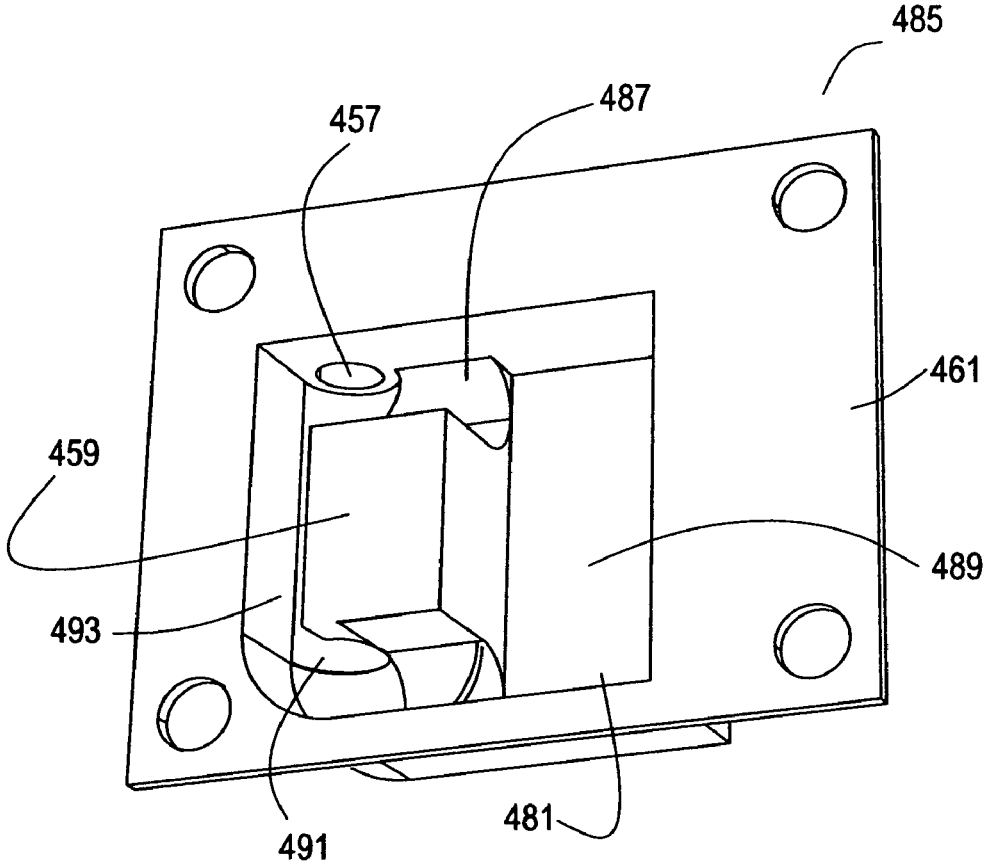
FIG. 26 is a detailed view of the lock house of the present invention
Figure 27:
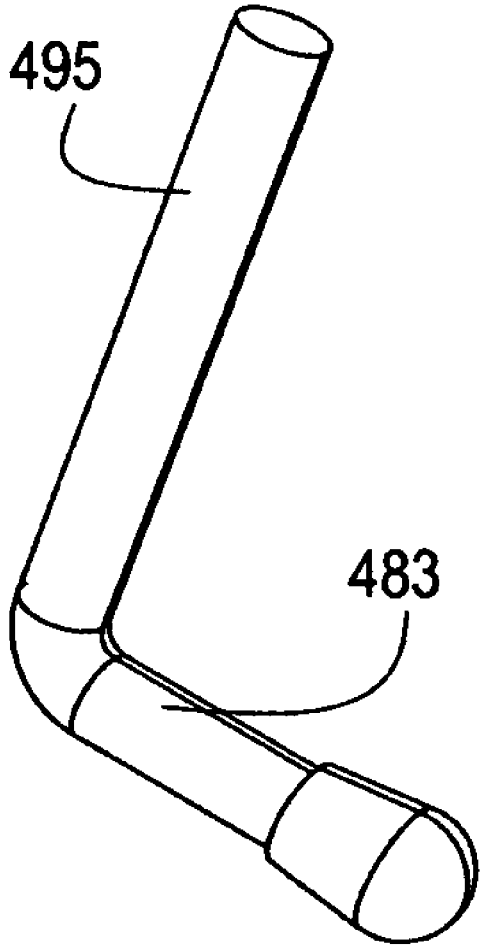
FIG. 27 is a detailed view of the lock pin assembly

Now with reference to FIGS. 14, 15, 16, in a further aspect of the present invention, the bottom surface 336 of the platform 342 has a plurality of indentations 340 operable to receive the third back edge 376 of the first leg member 330 and the fourth front edge 307 of the second leg member 308. The footstool can further comprise a connector (not shown) which is attached to the first leg member 330 and the second leg member 308 thereby unifying the operation of the leg members and facilitating ease of use. In unifying the operation, both the first and second leg members are engaged simultaneously. Therefore the platform 342 can only achieve positions which utilize both legs, i.e. with the second back edge 304 of the base assembly 324 raised off of the ground or floor and the platform 342 creating a smaller angle with the horizontal.

As will be appreciated, the selection and use of different materials and the specific assembly connections used for the connector may vary and are generally known to those skilled in the art. The connector may be flexible or rigid.

In the case of a rigid connection between the first leg member 330 and second leg member 308 a structural member 314 may be defined which has a fifth top surface 384, fifth bottom surface 347, first front surface 334, first back surface, first and second side surfaces 312.

In order to accommodate the structural member 314, the first leg member 330 may have a first opening 362 cut out of the end nearest the third back edge 370 defusing third and fourth inside edge 366 and 380 and the second leg member 308 may have a second opening 319 cut out of the end near the fourth front edge 307 further defining fifth and sixth inside edges 317 and 323. Structural member 314 is connected to the first leg member 330 via a pivot mechanism 378 and to the second, leg member 308 via pivot mechanism 305.

When neither the first nor second leg members 330 and 308 are engaged, the footstool of the present invention is in a closed position in which the platform 342 lies on top of base assembly 324. When in the closed position, the leg members 330 and 308 and connector or structural member 314 lie flat against the platform 342 and are flush with or nearly flush with the base assembly 324 thereby creating a support apparatus which portable and easy to store.

As depicted in FIGS. 17-27, in another aspect of the present invention, the bottom surface 448 of the platform 442 has a plurality of indentations 446 operable to receive the third back edge 490 of the first leg member 438 and the fourth front edge 435 of the second leg member 455. The fifth and sixth inside edges 451 and 437 of the second leg member 455 contain leg channels 420 and 453 and also have a generally cylindrical opening or first and second leg apertures 447 and 466. The opening or second leg aperture 447 in the sixth inside edge 437 is deeper creating an extended cylindrical barrel aperture 449. The barrel aperture 449 may also include a casing (not shown) which can sit inside of the barrel aperture 449 and protecting the inside surface from wear and tear.

In this aspect, there are also attachment mechanisms 475 and 467 with outwardly extending, cylindrical protrusions 471 and 463 with generally tubular protrusion apertures 473 and 465 in these protrusions 471 and 463 (i.e. they are hollow). These protrusions are generally the same shape and diameter as the leg apertures 447 and 466 allowing the protrusions 471 and 463 to be received by these first and second leg apertures. The attachment mechanisms 475 and 467 connect structural member 468 to the second leg member 455. When the protrusions 471 and 463 are received by the second leg member 455, they can rotate in the first and second leg apertures 447 and 466 creating a pivot motion and can slide along the leg channels 420 and 453.

The footstool can further comprise a locking mechanism 462 which has a lock house assembly 485 which includes a lock house 461 with a raised nub 459 which further defines a first lock channel 491, a second lock channel 487, a third lock channel 489 and a fourth lock channel 481. The nub 459 also has arcuate protrusions 493. The lock house 461 also has a lock house opening 457.

The lock house assembly 485 sits in a recess 477 in the structural member 468 with the lock house opening 457 aligned with a structural member opening 469 which further aligns with protrusion 463 and tubular aperture 465 and leg aperture 447 creating an passage from the lock house 461 through the structural member 468 and into the extended barrel aperture 449 in the sixth inside edge 451 of the second leg member 455.

The locking mechanism also has a generally L-shaped tubular lock pin assembly with a relatively wider first lock pin member 495 and a relatively narrower second lock pin member 483. The lock pin assembly is received by the lock house assembly 485 with the first lock pin member 495 sitting in the first lock channel 491 and held in place by arcuate protrusions 493. When not in use i.e. in the unlocked position, the first lock pin member 483 is completely within the lock house 461 with the second lock pin member 495 resting in the fourth lock channel 481. When the locking mechanism 462 is not engaged, the cylindrical protrusions 471 and 463 of the attachment mechanisms 475 and 467 can slide along leg channels 453 and 420 thereby allowing the structural member 468 to engage the first leg member 438 without engaging the second leg member 455. By enabling the first leg member to be engaged independent of the second leg member, the platform 442 of the footstool can be put in the first position i.e. the planar or nearly planar support surface 406 is at an incline facing the user.

To engage the locking mechanism, upward force is applied to the second lock pin member 483 while the first lock pin member 495 rotates within the first lock channel 491. The lock pin assembly is then moved across the lock house 461 by sliding the first lock pin member 495 along the first lock channel 491 until the second lock pin member 483 clears the raised nub 459. In so doing, the first lock pin member 495 moves through the lock house opening 457, structural member opening 469, tubular aperture 465, leg aperture 447 and into the extended barrel aperture 449 in the sixth inside edge 451 of the second leg member 455. Force is then applied to the second lock pin member 483 thereby rotating the first lock pin member 495 and enabling the second lock pin member 483 to rest in the second lock house channel 487 thereby engaging the locking mechanism in the locked position.

When the locking mechanism 462 is engaged in the locked position, the cylindrical protrusions 471 and 463 do not slide but rather rotate within the leg apertures 466 and 447 creating a pivot mechanism. When the first leg member 438 is engaged, the structural member 468 applies force to the second leg member 455 thereby engaging the second leg member 455 simultaneously with the first leg member 438. With this unified operation, the platform 442 can achieve positions which utilize both leg members, i.e. with the second back edge 410 of the base assembly 411 raised off of the ground or floor and the platform 442 creating a smaller angle with the horizontal i.e. at a less steep incline facing the user. The locking mechanism 462 gives the user the ability to determine which platform position she prefers and then engage the locking mechanism 462 in the unlocked or locked position such that subsequently the stool can be operated more easily, and for most users enable a one-handed operation. A pull strap 452 may be attached to the first leg member 438 to further enable ease of use.

To further facilitate ease of operation, the first bottom surface 448 of the platform 442 may have a backstop mechanism 452 which the first leg member abuts against and thereby prevents the first leg member 438 from becoming dislodged and moving beyond the engaged indentation on the bottom surface 448 of the platform 442 or splaying unintentionally. I currently contemplate that this backstop mechanism 452 will comprise nubs 454 which extend downward from said second bottom surface 448. However it should be understood that the exact configuration of the backstop mechanism can be varied.

When neither the first nor the second leg members 438 and 455 are engaged, the footstool of the present invention is in a closed position in which the platform 442 lies on top of base assembly 411. When in the closed position, the leg members 438 and 455 and structural member 468 lie flat against the platform 442 and are flush or nearly flush with the base assembly 411 thereby creating a support apparatus which is portable and easy to store. A hole 460 in the first leg member 438 will allow the backstop mechanism 452 to pass through when the footstool is in the closed position and enable the footstool to fold completely.

While any suitable material may be used to manufacture the folding footstool of the present invention, the preferred material is a laminate of bamboo or another hardwood, which is aesthetically pleasing and also provides a safe supporting structure capable of supporting the downward force from the foot and leg of the user. The choice of bamboo laminate is not critical, but should be of a resilient material of sufficient rigidity to hold the downward pressure exerted by the user. As will be appreciated, the selection and use of different materials in the construction of the stool and the specific assembly connections utilized may vary and are generally known to those skilled in the art.

It should be understood that the exact arrangement and configuration of the leg security mechanism can be varied. The invention described herein is not to be limited by a particular aspect showing a particular groove or slot or complimentary projection configuration. Specifically, variations, changes, modifications and departures from the groove and projection arrangements disclosed above may be adopted without departure from the scope or spirit of the present invention.

The present invention involves a folding footstool adjustable to multiple heights and multiple angles to assist in the feeding of an infant. The principles of the present invention, however, are not limited to collapsible footstools and it will be understood that, in light of the present disclosure, the folding footstool disclosed herein can be successfully used in connection with other types of stools and supports.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A folding support apparatus comprising:

a. a platform with a support surface, first front edge, a first back edge, a first side edge, a second side edge, a first top surface, and a first bottom surface having a plurality of indentations b. a base assembly with a second top surface, a second bottom surface, a second front edge, a second back edge, a third side edge, and a fourth side edge and which is attached to the platform via a hinging mechanism c. a first leg member with a third top surface, a third bottom surface, a third front edge, a third back edge, a fifth side edge and a sixth side edge wherein said first leg member is nested within a base opening in said base assembly sufficient to receive said first leg member and defining a first inside edge and a second inside edge and said first leg member is attached to said base assembly via a hinging mechanism wherein said first leg member can be rotated and said third front edge of said first leg can be received into one of said indentations of said first bottom surface of said platform causing said first front edge of said platform to be elevated above a ground surface defining a first position and creating a first angle where said first bottom surface of said platform meets the horizontal defined by said base assembly meeting said ground surface d. a second leg member with a fourth top surface, a fourth bottom surface, a seventh side edge, an eighth side edge, a fourth front edge, and a fourth back edge and which is pivotally mounted within said base opening in said base assembly sufficient to receive said second leg member allowing it to rotate such that said second leg member when positioned so that said fourth front edge of said second leg is received into at least one of said indentations of said first bottom surface of said platform and when said fourth back edge of said second leg member engages said ground surface said second bottom surface of said base assembly will be elevated above said ground surface elevating said platform to define a second angle and defining a second position.

* * * * *